US012582249B2

(12) United States Patent
Zhu et al.

(10) Patent No.: US 12,582,249 B2
(45) Date of Patent: Mar. 24, 2026

(54) PILLOW

(71) Applicants: Xingjian Zhu, Shanghai (CN); Senmiao Yang, Shanghai (CN); Qi Wei, Shanghai (CN); Hui Wang, Shanghai (CN); Minhua Zhao, Shanghai (CN)

(72) Inventors: Xingjian Zhu, Shanghai (CN); Senmiao Yang, Shanghai (CN); Qi Wei, Shanghai (CN); Hui Wang, Shanghai (CN); Minhua Zhao, Shanghai (CN)

( * ) Notice: Subject to any disclaimer, the term of this patent is extended or adjusted under 35 U.S.C. 154(b) by 0 days.

(21) Appl. No.: 18/796,347

(22) Filed: Aug. 7, 2024

(65) Prior Publication Data

US 2026/0041261 A1 Feb. 12, 2026

(51) Int. Cl.
*A47G 9/10* (2006.01)
*D04B 21/18* (2006.01)

(52) U.S. Cl.
CPC ..... *A47G 9/1036* (2013.01); *D04B 21/18* (2013.01)

(58) Field of Classification Search
CPC ..... A47G 9/1036; A47G 9/0253; A47G 2009/1018; A47G 9/10; A47G 27/0231; A47G 2009/008; D04B 21/18; A47C 27/15; A47C 27/064; A47C 27/22; A47C 21/046; A47C 27/056; A47C 31/105; A47C 27/085; A47C 27/20; A47C 31/001; A47C 27/05; A47C 27/07; A47C 27/124; A47C 31/11; A47C 21/042; A47C 23/0433; A47C 23/14; A47C 23/067; A47C 27/0453; A01K 1/0353
See application file for complete search history.

(56) References Cited

U.S. PATENT DOCUMENTS 12,115,116 B2 * 10/2024 Zoni, III ..... A47C 27/06
2022/0408946 A1 * 12/2022 Manuszak ..... A47C 27/15
2024/0090687 A1 * 3/2024 Micklos ..... A47G 9/0253

FOREIGN PATENT DOCUMENTS

CN 104768427 A * 7/2015 ..... A47C 21/046

* cited by examiner

*Primary Examiner* — Madison Emanski
(74) *Attorney, Agent, or Firm* — Riyon Rae Harding

(57) ABSTRACT

The present invention relates to a pillow and belongs to the technical field of bedding. The pillow comprises an outer pillow cover and a pillow core, wherein the pillow core is detachably filled in the outer pillow cover. The outer pillow cover comprises a first fabric layer and a second fabric layer, and a first phase-change material layer is arranged on an inner surface of the first fabric layer. The pillow core comprises an elastic material layer and a second phase-change material layer arranged on an outer surface of the elastic material layer. When the second phase-change material layer is close to the first phase-change material layer, the pillow can provide an extremely strong cooling effect. When the second phase-change material layer is far away from the first phase-change material layer, the pillow can provide a moderate cooling effect.

10 Claims, 4 Drawing Sheets

PILLOW

TECHNICAL FIELD

The present invention relates to the technical field of bedding, and in particular, to a pillow.

BACKGROUND

The pillow can support a user's head and neck to maintain the physiological curvature of the cervical spine, thereby helping to reduce pressures on muscles and joints. With the development of modern technology, the requirements of the user on pillows are gradually increasing. Especially in the hot summer, the sleeping quality of the user declines, as the temperature of the pillow's surface kept being contacted with the user increases after long-time contact.

To provide a better cooling experience, a cooling effect can be provided by adding a gel layer to the pillow core. However, the cooling effect of the gel layer cannot be adjusted. Some users may feel uncomfortable because the coldness of the gel layer is un-adjustable in use, which leads to an uncomfortable sleeping experience.

SUMMARY

To overcome the defects in the prior art that the cooling effect of the pillow cannot be adjusted, an embodiment of the present invention provides a pillow, which comprises an outer pillow cover and a pillow core detachably filled in the outer pillow cover. The outer pillow cover is made of a material capable of providing a cooling effect, a first phase-change material layer is arranged on an inner surface of the outer pillow cover, and a second phase-change material layer is arranged on an outer surface of the pillow core. Changing the stacking position of the pillow core in the outer pillow cover and changing the position of the outer surface of the outer pillow cover filled with the pillow core facing the user can provide the user with contact surfaces with different cooling effects.

To resolve the foregoing technical problem, an embodiment of the present invention provides the following technical solutions.

In a first aspect, an embodiment of the present invention provides a pillow, which comprises an outer pillow cover and a pillow core, wherein the pillow core is detachably filled in the outer pillow cover, the outer pillow cover comprises a first fabric layer and a second fabric layer, and a first phase-change material layer is arranged on an inner surface of the first fabric layer; and the pillow core comprises an elastic material layer and a second phase-change material layer arranged on an outer surface of the elastic material layer.

In an implementation of the first aspect, the first phase-change material layer is discontinuous.

In an implementation of the first aspect, the first phase-change material layer comprises a plurality of hexagonal structures arranged in a honeycomb shape, an interior of the hexagonal structure is filled with the first phase-change material, and an exterior of the hexagonal structure is not filled with the first phase-change material.

In an implementation of the first aspect, a ratio of an area of a region filled with the first phase-change material to a total area of the inner surface of the first fabric layer is about 30-90%.

In an implementation of the first aspect, the first fabric layer is made of nylon-spandex knitted fabric.

In an implementation of the first aspect, the second fabric layer is a knitted breathable fabric layer.

In an implementation of the first aspect, the first fabric layer and the second fabric layer are connected by a support layer, the support layer is an annular structure with a certain thickness, and the first fabric layer, the second fabric layer and the support layer are enclosed to form a cavity adapted to accommodate the pillow core.

In an implementation of the first aspect, the support layer is made of sandwich mesh cloth, and a top and a bottom of the support layer are both provided with continuous piped edges.

In an implementation of the first aspect, the pillow further comprises an inner pillow cover for accommodating the pillow core, and the inner pillow cover is detachably arranged within the outer pillow cover.

In an implementation of the first aspect, the second fabric layer comprises an elastic material strip that protrudes in a direction away from the outer pillow cover.

In an implementation of the first aspect, the pillow comprises in sequence: a knitted nylon-spandex fabric layer, the first phase-change material layer, the second phase-change material layer, the elastic material layer and a knitted breathable fabric layer.

In an implementation of the first aspect, the pillow comprises in sequence: a knitted nylon-spandex fabric layer, the first phase-change material layer, the elastic material layer, the second phase-change material layer and a knitted breathable fabric layer.

In an implementation of the first aspect, the pillow comprises in sequence: a knitted nylon-spandex fabric layer, the first phase-change material layer, a first mesh fabric layer, the second phase-change material layer, the elastic material layer, a second mesh fabric layer and a knitted breathable fabric layer.

In an implementation of the first aspect, the pillow comprises in sequence: a knitted nylon-spandex fabric layer, the first phase-change material layer, a first mesh fabric layer, the elastic material layer, the second phase-change material layer, a second mesh fabric layer and a knitted breathable fabric layer.

Compared with the prior art, the embodiment of the present invention has the following beneficial effects: the outer pillow cover of the pillow described herein may be made of a material capable of providing a cooling effect, a first phase-change material layer is arranged on an inner surface of the outer pillow cover, and a second phase-change material layer is arranged on an outer surface of the pillow core. The phase-change material in the phase-change material layer can absorb heat by phase change, thereby providing a cooling effect. Therefore, when the second phase-change material layer is close to the first phase-change material layer, the pillow can provide an extremely strong cooling effect. When the second phase-change material layer is far away from the first phase-change material layer, the pillow can provide a moderate cooling effect.

In addition, the other surface of the outer pillow cover may be a breathable fabric layer that does not comprise a phase-change material layer. The other outer surface of the pillow core does not comprise the phase-change material layer, and the pillow core is detachably filled in the outer pillow cover. As described in detail below, different outer surfaces of the outer pillow cover face the user, which can provide the user with four contact surfaces with different cooling effects.

In addition, the pillow core may be arranged within the inner pillow cover, and the inner pillow cover may be made of two layers of mesh fabric, which not only facilitates the user to see the second phase-change material layer on the outer surface of the pillow core, but also helps to put the pillow core into the outer pillow cover or take the pillow core out from the outer pillow cover.

In addition, the two fabric layers of the outer pillow cover may be connected by the support layer, which together are enclosed to form a cavity adapted to accommodate the pillow core. The support layer can be made of sandwich mesh cloth, which not only can increase the breathability of the pillow, but also can provide enough support force for the outer pillow cover to maintain the three-dimensional structure.

BRIEF DESCRIPTION OF DRAWINGS

The embodiments of the present invention may be better understood by describing the implementations of the embodiments of the present invention in conjunction with the accompanying drawings, in which.

Figure 1:
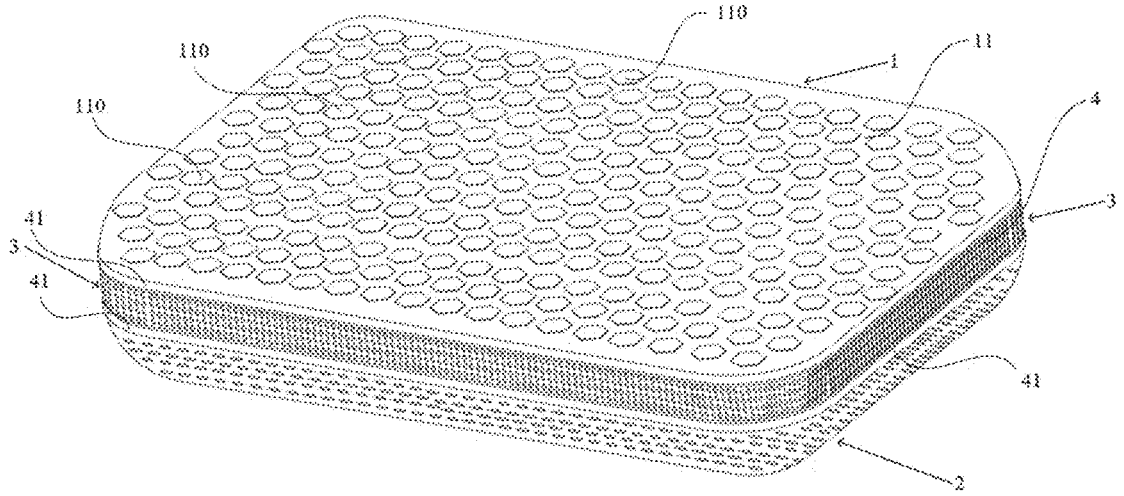
FIG. 1 is a schematic diagram of a structure of a pillow according to an implementation of an embodiment of the present invention.

In the drawings, the reference numerals have the following meanings:

a first fabric layer 1;
a first phase-change material layer 11;
a hexagonal structure 110;
a second fabric layer 2;
an elastic material strip 22;
an elastic material layer 3;
a second phase-change material layer 31;
a support layer 4; and
piped edge 41.

DETAILED DESCRIPTION OF EMBODIMENTS

Unless otherwise defined, the technical terms or scientific terms used in this specification and claims shall have the ordinary meaning understood by those of ordinary skill in the art to which the present invention belongs.

All numerical values recited herein as between the lowest value and the highest value are intended to mean all values obtained in increments of one unit between the lowest value and the highest value when there is a difference of more than two units between the lowest value and the highest value.

In the description of the present invention, it should be understood that directions or positional relationships indicated by terms "central", "longitudinal", "lateral", "upper", "lower", "front", "rear", "left", "right", "vertical", "horizontal", "top", "bottom", "inner", "outer", and the like are those shown based on the accompanying drawings, and are merely intended to facilitate and simplify description rather than indicate or imply that the indicated apparatus or element must have a specific direction and must be configured and operated according to the specific direction. Therefore, these directions or positional relationships should not be construed as limiting the present invention.

Furthermore, the terms "first" and "second" are merely intended for a purpose of description, and shall not be understood as an indication or implication of relative importance or an implicit indication of a quantity of indicated technical features. Therefore, a feature limited by "first", "second" and the like may explicitly indicate or implicitly include one or more such features. In descriptions of the present invention, unless otherwise stated, "a plurality of" means two or more than two.

Embodiment 1

This embodiment provides a pillow, which may comprise an outer pillow cover and a pillow core, wherein the pillow core is detachably filled in the outer pillow cover.

Figure 2:
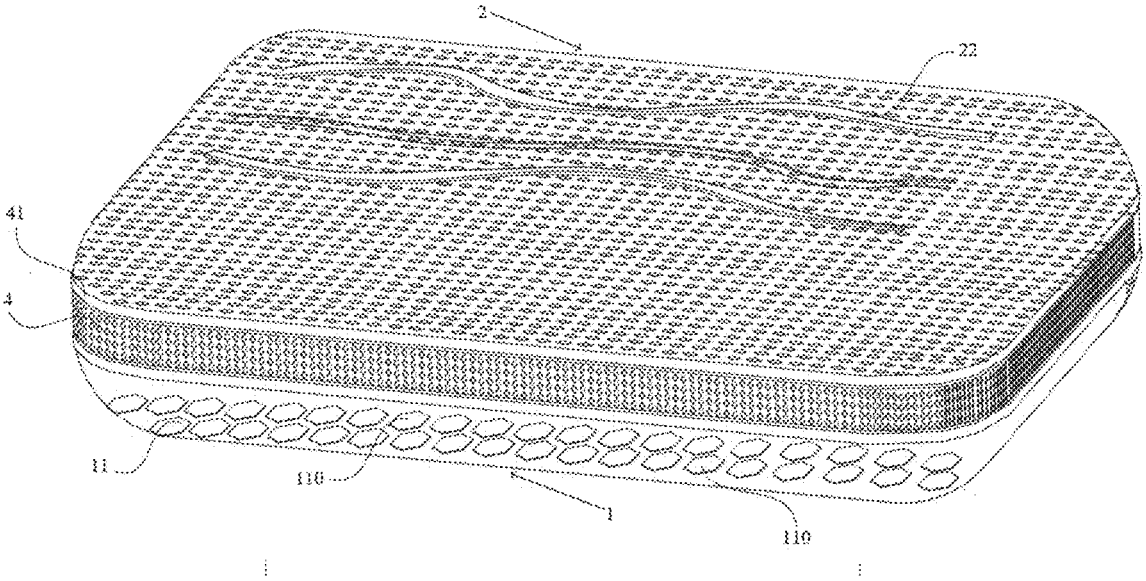
FIG. 2 is a schematic diagram of a structure of a pillow according to another implementation of an embodiment of the present invention.
Figure 3:
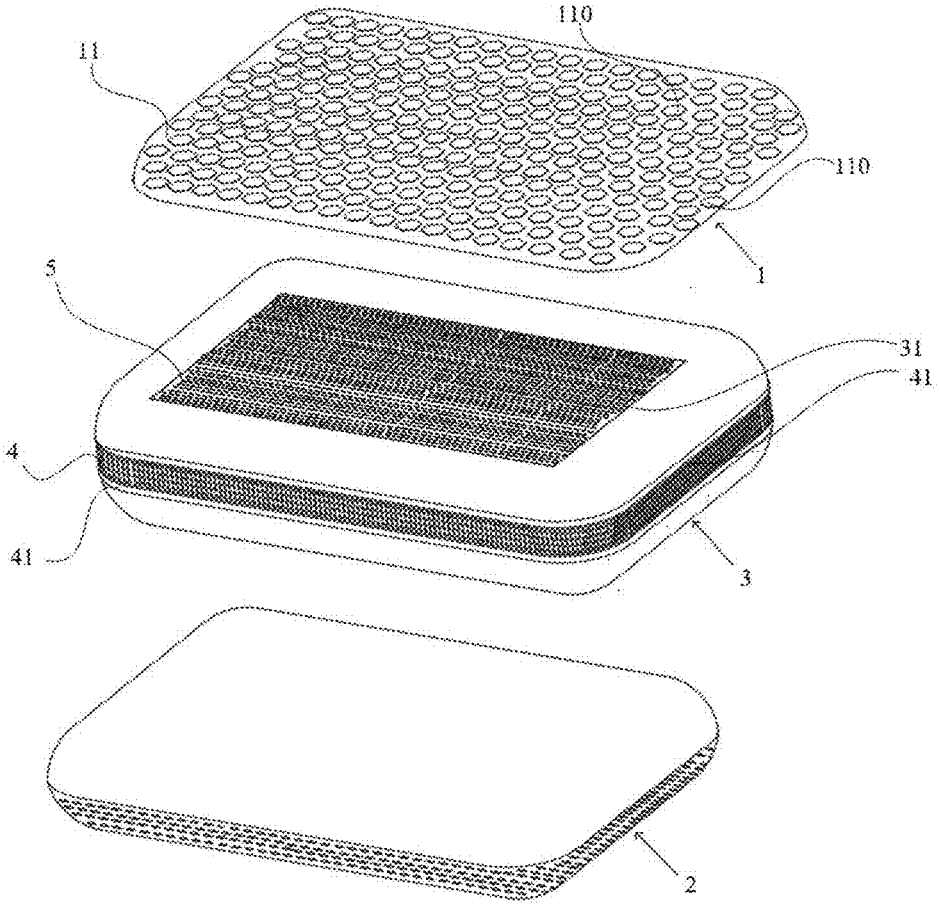
FIG. 3 is an exploded view of a structure of a pillow according to an implementation of an embodiment of the present invention.

In a specific implementation, as shown in FIGS. 1 to 3, the outer pillow cover may comprise a first fabric layer 1 and a second fabric layer 2. The first fabric layer 1 may be made of nylon-spandex knitted fabric. The nylon-spandex knitted fabric is a cool fabric and can be used as a base fabric of the first phase-change material layer. In a specific implementation, the nylon-spandex knitted fabric may be made of nylon and spandex. Preferably, the nylon-spandex knitted fabric may be made of 90% of nylon and 10% of spandex by weight. The nylon can provide a cooling experience. In addition, the nylon-spandex knitted fabric is soft, smooth and elastic, and can improve the user experience.

Figure 4:
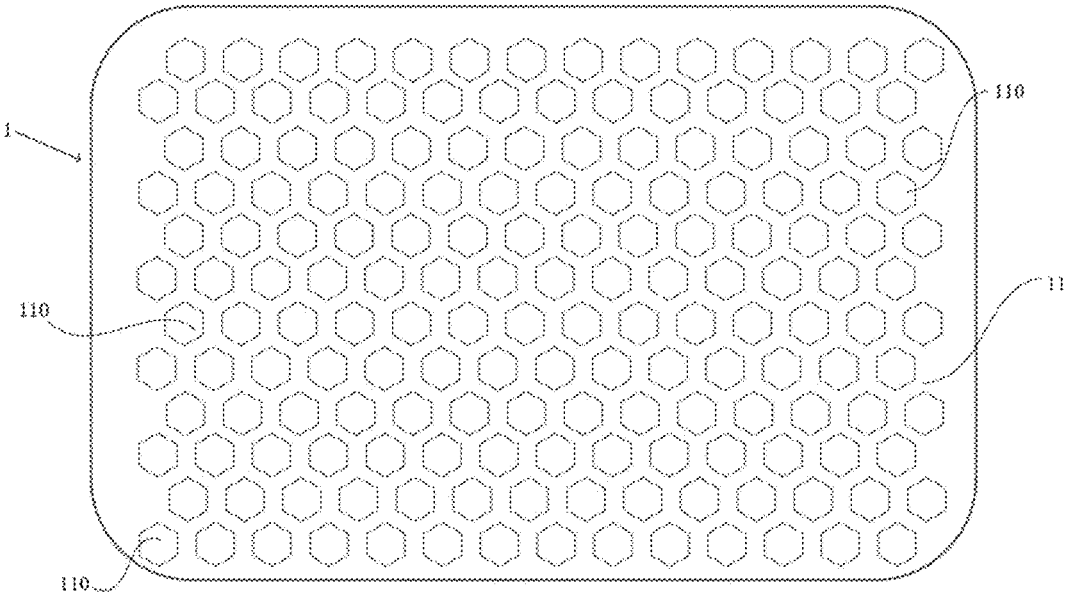
FIG. 4 is a schematic diagram of a structure of a first phase-change material layer according to an implementation of an embodiment of the present invention.

A first phase-change material layer 11 is arranged on an inner surface of the first fabric layer 1. As shown in FIG. 4, the first phase-change material layer 11 is discontinuous. Specifically, the first phase-change material layer 11 comprises a plurality of hexagonal structures 110 arranged in a honeycomb shape, wherein an interior of the hexagonal structure 110 is filled with the first phase-change material, and an exterior of the hexagonal structure 110 is not filled with the first phase-change material. In a specific implementation, the first phase-change material layer 11 may be provided on the first fabric layer 1 in the form of printing. The first phase-change material layer 11 may be white. The phase-change material in the first phase-change material layer 11 can absorb heat through undergoing phase-change reactions, which provides an enhanced cooling experience.

In addition, the first phase-change material layer 11 is arranged on the inner surface of the first fabric layer 1, so that damages to the first phase-change material layer 11 caused by friction in the use process of the pillow can be reduced, and the risk that the first phase-change material layer 11 falls off from the first fabric layer 1 is reduced.

In addition, the pillow can be deformed due to long-time squeeze by the head of a user in the use process, the stress concentration can be reduced by arranging the hexagonal structure 110 in the honeycomb shape, the probability that the first phase-change material layer 11 falls off from the outer pillow cover is reduced, and thus the service life of the pillow is prolonged. In addition, a hexagon is the most material-efficient shape when filling a plane. The hexagonal structure has the advantages that the amount of the used first phase-change material is decreased, and the area of the contacting-region for use of the first phase-change material is increased. Meanwhile, enough ventilation channels are reserved, and a dual experience of cooling and breathability is achieved.

In a specific implementation, in the inner surface of the first fabric layer 1, the ratio of the area of the region filled with the first phase-change material to the total area of the inner surface of the first fabric layer 1 is about 30-90%. When the region filled with the first phase-change material is too small, an enhanced cooling experience cannot be provided; and when the region filled with the first phase-change material is too large, the breathability of the outer pillow cover may be reduced. In a preferred implementation, the ratio of the area of the region filled with the first phase-change material to the total area of the inner surface of the first fabric layer is about 30%, 50%, 70%, 90% or a range or subrange therebetween.

The second fabric layer 2 may be a knitted breathable fabric layer. In a specific implementation, the knitted breathable fabric layer may be made of polyester and viscose fiber. Preferably, the knitted breathable fabric layer may be made from 67% polyester and 33% viscose fiber by weight. The second fabric layer 2 has a certain thickness, so that the requirements of the user and seasons with non-strong cool feeling can be met. In addition, the second fabric layer contains viscose fiber, so that the fabric feels softer.

In a specific implementation, as shown in FIG. 2, an outer surface of the second fabric layer 2 may be provided with an elastic material strip 22 protruding in a direction away from the outer pillow cover, and the elastic material strip 22 can increase the friction between the pillow cover and the head of the user, so as to provide an anti-slip effect.

In an implementation, the pillow core may comprise an elastic material layer 3 and a second phase-change material layer 31 arranged on an outer surface of the elastic material layer 3. The elastic material may be a sponge. The second phase-change material layer 31 may be a layer of blue slurry coating, and is well bonded to the elastic material layer 3.

In a specific implementation, an upper surface and a lower surface of the elastic material layer 3 are curved. The second phase-change material layer 31 is disposed on an outer surface of the elastic material layer 3, so that the slurry coating is bonded to the curved upper surface of the elastic material layer, and the second phase-change material layer 31 is evenly distributed on the upper surface of the elastic material layer 3. The user can contact different regions of the pillow when turning over, and the evenly distributed second phase-change material layer 31 can improve the cooling efficiency of the pillow. In a specific implementation, the second phase-change material layer 31 may be blue, so that the user can visually observe the outer surface of the pillow core provided with the PCM cooling coating, which facilitates confirmation of the upper surface and the lower surface of the pillow core in the use process.

In an implementation, the first fabric layer 1 and the second fabric layer 2 are connected by a support layer 4, the support layer 4 is an annular structure with a certain thickness. The first fabric layer 1, the second fabric layer 2 and the support layer 4 are enclosed to form a cavity adapted to accommodate the pillow core. In an implementation, the support layer 4 is made of sandwich mesh cloth, and a top and a bottom of the support layer 4 are both provided with continuous piped edges 41.

When the pillow is in use, the pillow is squeezed and deformed under the action of the head of the user. In this case, the air originally gathered inside the pillow core is squeezed out of the pillow core under the action of external force, and the air can be smoothly discharged from the pillow through the sandwich mesh cloth 3.

In a specific implementation, the mesh of the sandwich mesh cloth is diamond-shaped. The pillow may be used to support the neck and head of a user. The pillow may be squeezed in the use process, and in this case, the pillow core and the pillow cover may be deformed under the action of external force. The diamond-shaped sandwich mesh fabric has good supporting properties, so that the pillow can maintain sufficient gusset and maintain the three-dimensional shape. Meanwhile, the diamond-shaped sandwich mesh cloth can enable air to freely circulate, and thus good breathability is maintained.

The piped edge 41 is arranged at the top and bottom of the support layer 3, so that the edge of the support layer 3 is not in direct contact with the outside. The edge of the support layer 3 is protected, and the edge of the support layer 3 is prevented from being scattered in daily use. In addition, the piped edge 41 protects the support layer 4 from being directly contacted with the user, which avoids wear and prolongs the service life of the pillow cover. The piped edge 41 may be of a different color to the rest of the pillow cover and has a decorative effect.

In a specific implementation, the pillow may comprise in sequence: a knitted nylon-spandex fabric layer, a first phase-change material layer, a second phase-change material layer, an elastic material layer and a knitted breathable fabric layer. In this case, the first phase-change material layer is close to the second phase-change material layer. If the knitted nylon-spandex fabric layer is positioned close to the user, an extremely strong cooling experience may be provided, which is particularly suitable for use in summer. This cooling experience is from the knitted nylon-spandex fabric layer, the first phase-change material layer, and the second phase-change material layer at the same time. Conversely, if the knitted breathable fabric layer is positioned close to the user, a temperature suitable for all seasons may be provided.

In a specific implementation, the pillow comprises in sequence: a knitted nylon-spandex fabric layer, a first phase-change material layer, an elastic material layer, a second phase-change material layer and a knitted breathable fabric layer. In this case, the first phase-change material layer is far away from the second phase-change material layer. If the knitted nylon-spandex fabric layer is positioned close to the user, a moderate cooling experience may be provided. This cooling experience is from both the knit nylon ammonia fabric layer and the first phase-change material layer. Conversely, if the knitted breathable fabric layer is positioned close to the user, a moderate cooling experience may also be provided. This cooling experience is mainly from the second phase-change material layer.

Embodiment 2

This embodiment relates to a pillow. This embodiment is different from Embodiment 1 in that the pillow of this embodiment further comprises an inner pillow cover. The inner pillow cover is detachably arranged in the outer pillow cover and is used to accommodate the pillow core. In a specific implementation, the inner pillow cover may be made from a first mesh fabric layer and a second mesh fabric layer. The mesh fabric is breathable, and the user can visually see a cooling layer of the elastic material layer through the mesh fabric layer. In addition, the inner pillow cover helps to put the pillow core into the outer pillow cover or take the pillow core out from the outer pillow cover.

In a specific implementation, the pillow may comprise in sequence: a knitted nylon-spandex fabric layer, a first phase-change material layer, a first mesh fabric layer, a second phase-change material layer, an elastic material layer, a second mesh fabric layer and a knitted breathable fabric layer. In this case, the first phase-change material layer is close to the second phase-change material layer. Similarly, the knitted nylon-spandex fabric layer may be positioned close to the user, or the knitted breathable fabric layer may be positioned close to the user, so that a different cooling experience is achieved.

In a specific implementation, the pillow comprises in sequence: a knitted nylon-spandex fabric layer, a first phase-change material layer, a first mesh fabric layer, an elastic material layer, a second phase-change material layer, a second mesh fabric layer and a knitted breathable fabric layer. In this case, the first phase-change material layer is far away from the second phase-change material layer. Similarly, the knitted nylon-spandex fabric layer may be positioned close to the user, or the knitted breathable fabric layer may be positioned close to the user, so that a different cooling experience is achieved.

The objectives, technical solutions and beneficial effects of the present invention are further explained in detail with reference to the specific embodiments described above, and it should be understood that the above-mentioned contents are merely specific embodiments of the present invention, and are not intended to limit the present invention. Any modification, equivalent substitution, improvement, etc., made within the spirit and principle of the present invention shall all fall within the protection scope of the present invention.

What is claimed is:

1. A pillow, comprising an outer pillow cover and a pillow core, wherein the pillow core is detachably filled in the outer pillow cover, the outer pillow cover comprises a first fabric layer and a second fabric layer, and a first phase-change material layer is arranged on an inner surface of the first fabric layer, wherein the first phase-change material layer is discontinuous, wherein the first phase-change material layer comprises a plurality of hexagonal structures arranged in a honeycomb shape, wherein an interior of the hexagonal structure is filled with the first phase-change material, and an exterior of the hexagonal structure is not filled with the first phase-change material; and the pillow core comprises an elastic material layer and a second phase-change material layer arranged on an outer surface of the elastic material layer.

2. The pillow according to claim 1, wherein a ratio of an area of a region filled with the first phase-change material to a total area of the inner surface of the first fabric layer is 30-90%.

3. The pillow according to claim 1, wherein the first fabric layer and the second fabric layer are connected by a support layer, the support layer is an annular structure with a thickness, and the first fabric layer, the second fabric layer and the support layer are enclosed to form a cavity adapted to accommodate the pillow core.

4. The pillow according to claim 3, wherein the support layer is made of sandwich mesh cloth, and a top and a bottom of the support layer are both provided with continuous piped edges.

5. The pillow according to claim 1, further comprising an inner pillow cover for accommodating the pillow core, wherein the inner pillow cover is detachably arranged within the outer pillow cover.

6. The pillow according to claim 1, wherein the second fabric layer comprises an elastic material strip that protrudes in a direction away from the outer pillow cover.

7. The pillow according to claim 1, wherein the pillow comprises in sequence:

a knitted nylon-spandex fabric layer, the first phase-change material layer, the second phase-change material layer, the elastic material layer and a knitted breathable fabric layer.

8. The pillow according to claim 1, wherein the pillow comprises in sequence:

a knitted nylon-spandex fabric layer, the first phase-change material layer, the elastic material layer, the second phase-change material layer and a knitted breathable fabric layer.

9. The pillow according to claim 1, wherein the pillow comprises in sequence:

a knitted nylon-spandex fabric layer, the first phase-change material layer, a first mesh fabric layer, the second phase-change material layer, the elastic material layer, a second mesh fabric layer and a knitted breathable fabric layer.

10. The pillow according to claim 1, wherein the pillow comprises in sequence:

a knitted nylon-spandex fabric layer, the first phase-change material layer, a first mesh fabric layer, the elastic material layer, the second phase-change material layer, a second mesh fabric layer and a knitted breathable fabric layer.

* * * * *